US005226215A

United States Patent [19]

Evenson

[11] Patent Number: 5,226,215

[45] Date of Patent: Jul. 13, 1993

[54] CLIPBOARD HAVING A VARIABLE POSITION CLIP

[75] Inventor: Mel Evenson, San Pedro, Calif.

[73] Assignee: Eldon Industries, Inc., Inglewood, Calif.

[21] Appl. No.: 597,791

[22] Filed: Oct. 15, 1990

Related U.S. Application Data

[63] Continuation-in-part of Ser. No. 536,489, Jun. 12, 1990.

[51] Int. Cl.[5] ..... B42F 1/00; B42D 17/00

[52] U.S. Cl. ..... 24/67.5; 24/67.3; 24/67.11; 281/45

[58] Field of Search ..... 24/67.5, 67 R, 67.3, 24/67.11, 67.9, 67.7, 662, 488; 248/452; 281/45; 109/29; 362/99

[56] References Cited

U.S. PATENT DOCUMENTS

| | | | |
|---|---|---|---|
| D. 229,033 | 11/1973 | Cooper . | |
| D. 286,894 | 11/1986 | Haas et al. . | |
| 487,959 | 12/1892 | McDonald . | |
| 1,243,326 | 10/1917 | Marsh | 24/67.5 |
| 1,376,753 | 5/1921 | Febrey . | |
| 1,428,900 | 9/1922 | Oppenheimer . | |
| 1,431,306 | 10/1922 | Horwitz | 24/67.5 |
| 1,759,989 | 5/1930 | Leaman . | |
| 2,312,436 | 3/1943 | Oldham . | |
| 2,329,974 | 9/1943 | Bennett . | |
| 2,400,058 | 5/1946 | Concannon | 24/67.3 |
| 2,549,200 | 4/1951 | Hooks | 24/67.9 |
| 2,876,022 | 3/1959 | Kroviak . | |
| 2,891,295 | 6/1959 | Little | 24/67.3 |
| 2,996,775 | 8/1961 | Vernon | 24/67.3 |
| 3,167,329 | 1/1965 | Ernst . | |
| 3,216,742 | 11/1965 | Strain . | |
| 3,272,206 | 9/1966 | Ricke . | |
| 3,597,813 | 8/1971 | Takahashi et al. . | |
| 3,697,737 | 10/1972 | Levkoff | 362/99 |
| 4,243,249 | 1/1981 | Goss . | |
| 4,253,216 | 3/1981 | Brown | 24/67.3 |
| 4,401,323 | 8/1983 | Rex | 281/45 |
| 4,501,438 | 2/1985 | McKee | 24/67.11 |
| 4,603,883 | 8/1986 | Barbieri et al. | 248/452 |
| 4,623,169 | 11/1986 | Hutten | 24/67.3 |
| 4,628,572 | 12/1986 | Chang . | |
| 4,645,163 | 2/1987 | Zovar | 248/452 |
| 4,745,662 | 5/1988 | Chang . | |
| 4,763,389 | 8/1988 | Chang . | |
| 4,773,786 | 9/1988 | Pozzobon | 24/67.11 |
| 4,904,104 | 2/1990 | Gloeckle . | |
| 4,955,576 | 9/1990 | Moberg | 248/452 |
| 4,961,249 | 10/1990 | Liu et al. | 24/67.3 |

FOREIGN PATENT DOCUMENTS

| | | | |
|---|---|---|---|
| 0931369 | 8/1955 | Fed. Rep. of Germany | 24/67.11 |
| 718888 | 11/1954 | United Kingdom | 24/67.3 |

*Primary Examiner*—Victor N. Sakran
*Attorney, Agent, or Firm*—Price, Gess & Ubell

[57] ABSTRACT

A clipboard includes a board having edges and positioning means, where the positioning means allows a clip to be detachably mounted at particular positions along the board's edges.

11 Claims, 5 Drawing Sheets

FIG. 1
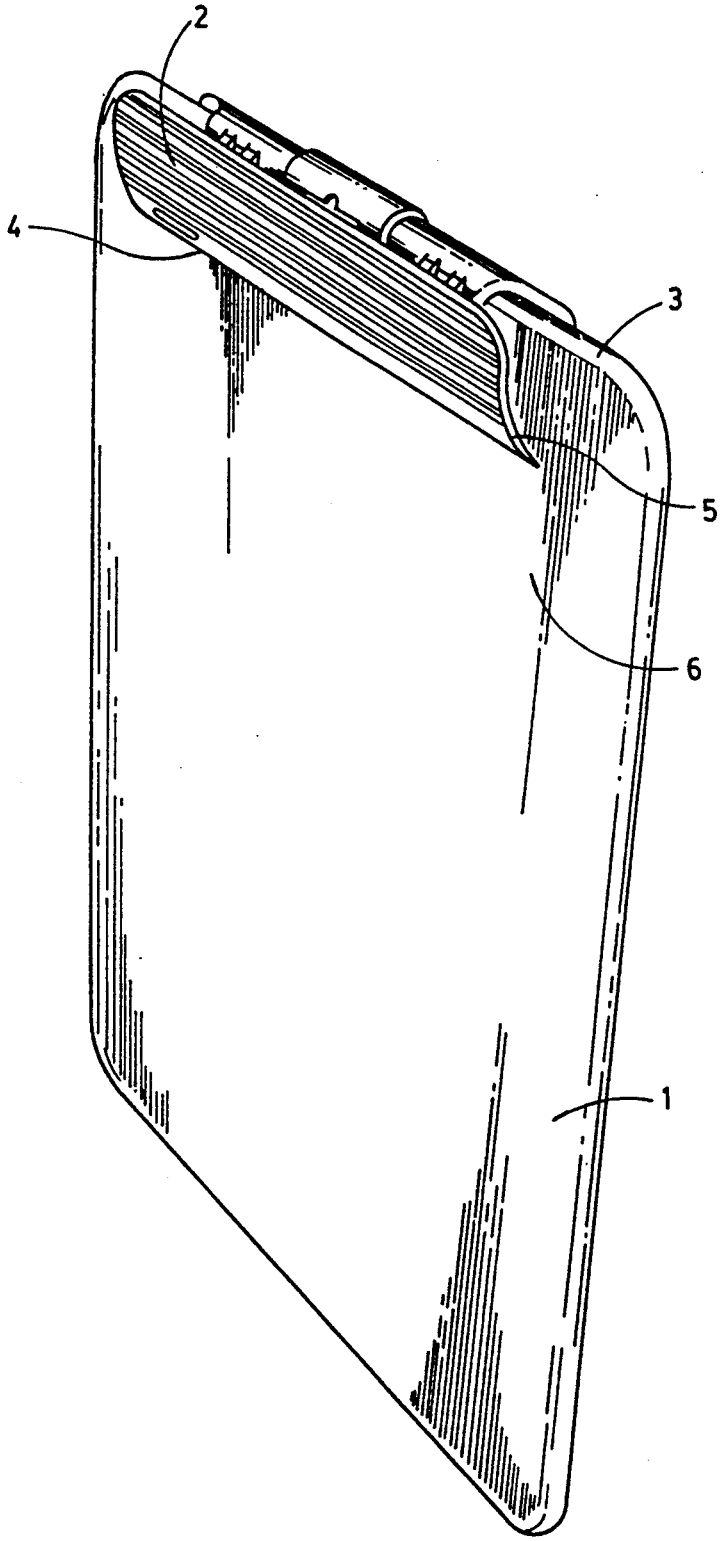
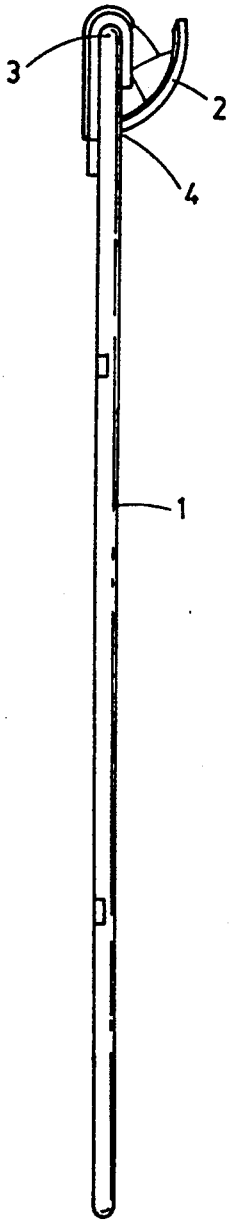
FIG. 1a

CLIPBOARD HAVING A VARIABLE POSITION CLIP

CROSS-REFERENCE TO RELATED APPLICATIONS

This application is a continuation-in-part of copending Design Application Ser. No. 536,489 filed Jun. 12, 1990.

FIELD OF THE INVENTION

This invention relates to clipboards and, more particularly, to clipboards wherein the clip is detachably mountable to the edge of a board.

BACKGROUND OF THE INVENTION

Conventional clipboards commonly consist of a hardback board with a clip mounted thereon for holding sheet and other types of materials for use by the holder of the board. The clip may be spring loaded, and several workpieces, such as several sheets of paper, may be attached to the board by clamping them with the springable clip.

When the paper is held in place by the clip on the clipboard, the paper may be worked upon using the hardback board as a writing or support surface. Furthermore, when traveling, the board serves as an easy storage place for many papers and memoranda.

The most common type of board in use today is a single hardback board having dimensions slightly larger than a workpiece sheet of paper. A metallic clip is riveted to the front surface of the board slightly below one edge (hereinafter called the "top edge").

The metallic clip has two pieces which are springably combined. The first piece is a base which is riveted or otherwise fixedly attached to the surface of the board. A second piece is a movable clip which may pivot in order to clamp the workpieces to the board. A spring for placing tension is wound around a pivot or rod mechanism in such a way as to force the clamp mechanism to place force on the workpiece papers.

In many instances, it becomes necessary to use the clipboard for workpieces such as paper which are larger than the board itself or where the user needs to write or draw in both the longitudinal and crosswise directions. At times, the placement of the clip will directly inhibit interaction of the user with a particular part of the workpiece. It then becomes necessary to release the clip and remove the workpiece for a reorientation on the board.

When the paper is removed from the clamping of the clip or reoriented in a different direction of the board, the clamp does not offer the same clamping mechanism or pivoting mechanism which is offered when the clamp is centrally located at the top edge of the board.

Furthermore, because of the permanent attachment of the clamp to the clipboard, many clipboards become unusable if either the board or the clip should individually break. For instance, oftentimes with cardboard-type clipboards, the board will become bent, ripped, or broken, and the board itself will be unusable. Thus, the entire clipboard and clamp combination must be discarded.

In another common instance, the clipboard spring becomes broken and the clip will no longer provide clamping force to the workpiece paper. Once again, the entire clipboard must be totally discarded.

Furthermore, common clipboards inadequately provide for clamping of different shaped pieces such as workpieces or writing utensils, i.e.: pens and pencils. Oftentimes the user will initially clamp his or her workpiece to the board and then interact with the workpiece clamped to the board, using a writing utensil.

When the user wishes to temporarily cease from interacting with the workpiece, the clamp will be lifted and the writing utensil will additionally be clipped to the clipboard above the workpiece. When this happens, the clamp no longer provides a dispersed clamping force across an edge of the workpiece, but provides a single discrete clamping force where the writing utensil is held in place. Many times when traveling, this allows the workpiece to be jarred from place and lost or ruined.

OBJECTS OF THE INVENTION

It is therefore an object of the invention to provide a clipboard which may adapt to different writing positions of the user and still provide an adequate clamping force in each orientation.

It is a further object of the invention to provide a clipboard with a clip that may be prevented from inhibiting the user's interaction with the workpiece in any direction, while still providing adequate support for the workpiece.

It is yet a further object of the invention to provide a clipboard which does not require the workpiece to be reoriented on the board when the clamp is seen to inhibit the interaction.

It is yet a still further object of the present invention to provide a clip which accounts for the clamping of the writing utensil while maintaining a disbursed clamping force across the workpiece.

It is yet a still further object of the present invention to provide a clipboard where only the component which may become broken must be discarded and unbroken components may be reused.

Further objections of the present invention will become apparent from the specification which follows.

SUMMARY OF THE INVENTION

The invention may generally be described as a clipboard including a board having edges and positioning means. The positioning means allows a clip to be detachably mounted at particular positions along the board's edges.

In the preferred embodiment of the invention, the clip and the clipboard are separable components. The clip is a single unit which fits around the edge of the board. The clamping force asserted by the clip on a workpiece which is to be secured to the board aids the clip in maintaining its own secured attachment to the board. The clip may be removed or detached at will.

The positioning means utilized in the board of the preferred embodiment includes preformed grooves in the board's rear surface. The clamp includes projections which mate with the preformed grooves in the board to position the clip at predefined locations. When the projections on the clip interact with the grooves, the clip may be locked into place on the board.

The clip of the preferred embodiment also includes an aid for detachably securing a writing utensil to the board's rear surface. For this purpose, the clip includes lateral projections which are displaced from the bottom of the board when the clip is attached to the board. The distance between the board and the lateral projections is sufficient to allow a writing utensil to be clamped therebetween. The clamping force of the clip will additionally provide the securing force for the writing utensil. A groove may be molded or otherwise formed into the board's surface or rear surface to allow accurate positioning of the utensil.

The clip of the preferred embodiment also includes a hanging or hooking means which allows the clipboard to be hooked or otherwise hung for storage. The hanging means is a movable piece secured to the clip. The hanging means may be maintained in an unobtrusive position or may be extended, allowing the clipboard to be hung in place.

BRIEF DESCRIPTION OF THE DRAWINGS

The present invention, both as to its organization and manner of operation, together with further objects and advantages, may be understood by reference to the following drawings.

FIG. 1 is a perspective illustration of the clipboard of the preferred embodiment;

FIG. 1A is a side view of the clipboard of the preferred embodiment;

DETAILED DESCRIPTION OF THE PREFERRED EMBODIMENTS

Figure 2:
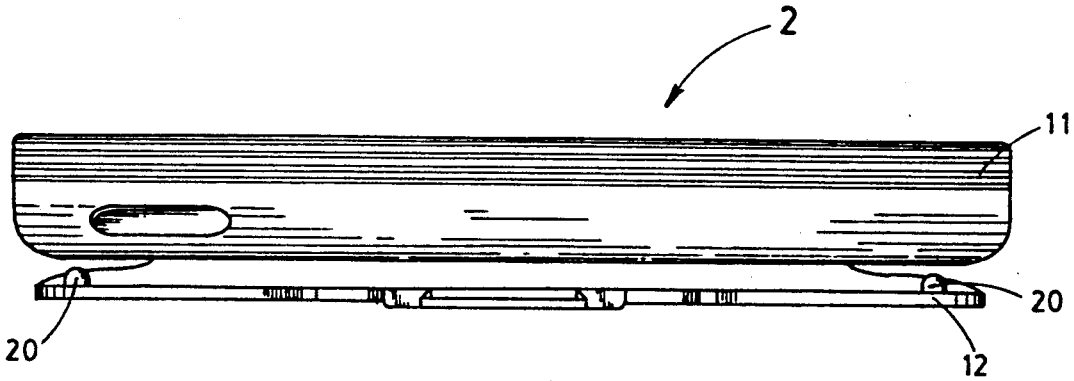
FIG. 2 is a front view of the clip of the preferred embodiment.
Figure 3:
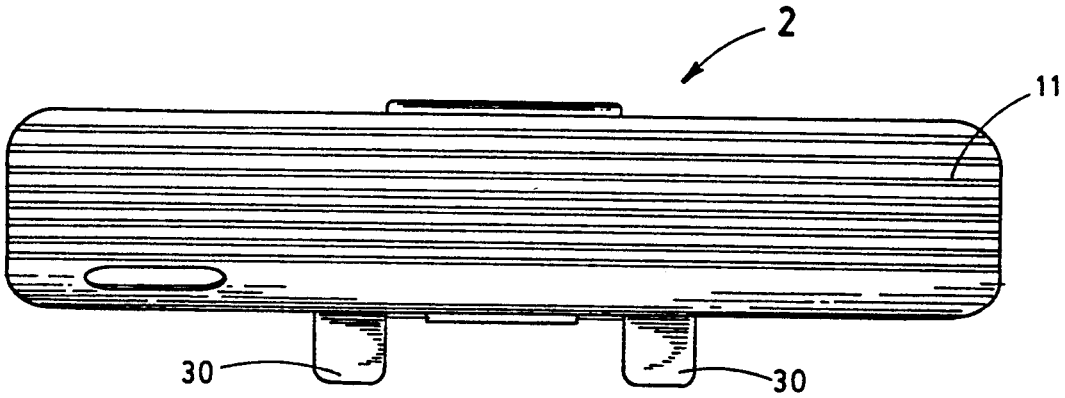
FIG. 3 is a top view of the clip of the preferred embodiment.
Figure 4:
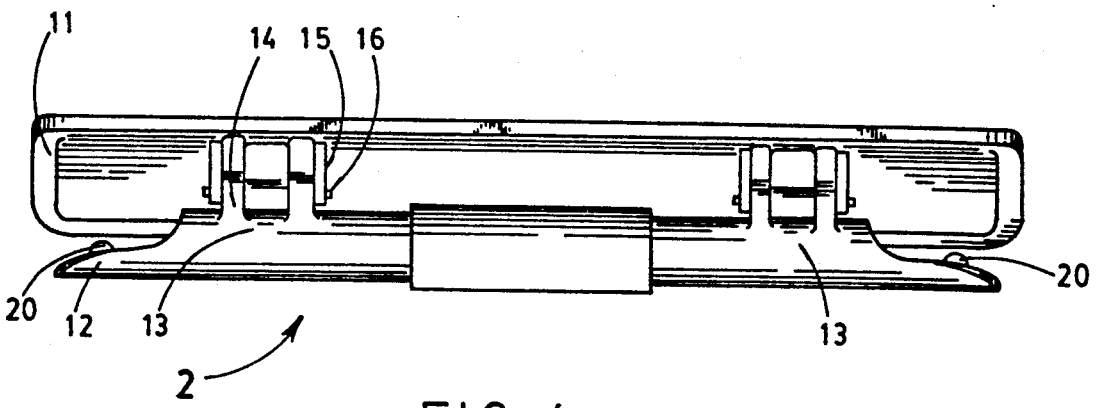
FIG. 4 is a rear view of the clip of the preferred embodiment.
Figure 5:
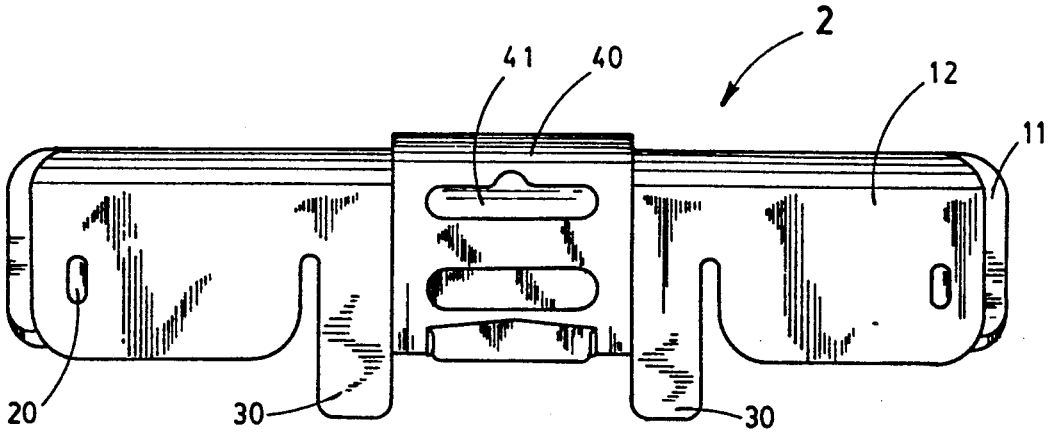
FIG. 5 is a bottom view of the clip of the preferred embodiment.
Figure 6:
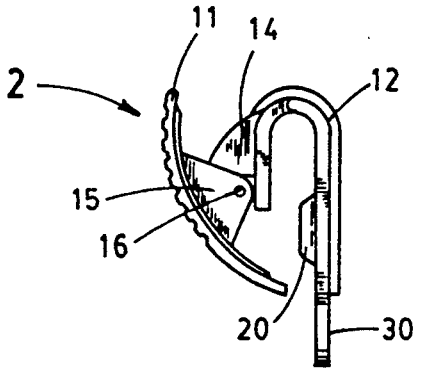
FIG. 6 is a side view of the clip of the preferred embodiment.
Figure 7:
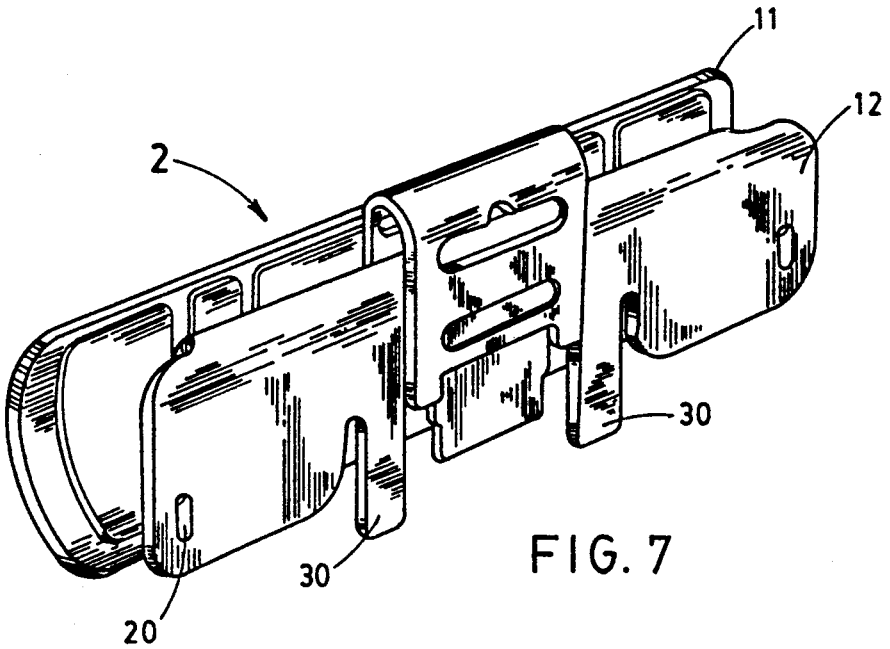
FIG. 7 is a perspective view showing the bottom of the clip of the preferred embodiment.

The following description is provided to enable any person skilled in the art to make and use the invention and sets forth the best modes contemplated by the inventor of carrying out his invention. Various modifications, however, will remain readily apparent to those skilled in the art.

As shown in FIG. 1, the clipboard of the preferred embodiment includes a board 1 and a clip 2 which fits around the board's edge 3. The workpiece (not shown) may be applied to the clipboard by placement between the board 1 and the clip 2. This space is indicated by reference numeral 4.

The compressive force of the clip 2 will hold the workpiece in place by causing the workpiece to frictionally interact with the clips forcing edge 5 and the board's surface 6.

In use, the clip 2 and clipboard of the preferred embodiment interact with a workpiece in a conventional manner. When the clip 2 is locked in position on the board 1, the workpiece is attachably secured by springably pivoting the clip 2 back and slipping the workpiece into the opening 4. When the clip 2 is released and allowed to extend back into its natural formation, a frictional force is applied to the workpiece displaced along the clip's forcing edge 5.

Various views of the clip 2 of the preferred embodiment are illustrated in FIGS. 2 through 7.

The clip is generally comprised of a top portion 11 and a bottom portion 12. The top portion 11 and bottom portion 12 are hingeably and springably attached via a plurality of pivot mechanisms 13.

The pivot mechanisms 13 include a pivot base 14 attached to the bottom piece 12. The pivot base 14 fits inside a pivot attachment 15 attached to the top piece 11. A pin 16 is molded into the pivot attachment 15. The pin 16 fits through holes (not shown) in the pivot base 14.

Each of the pieces for the clip mechanism may be molded from a suitable plastic, and a spring mechanism (not shown) may be provided by a metallic spring or by the resilience molded into the plastic itself.

Figure 8:
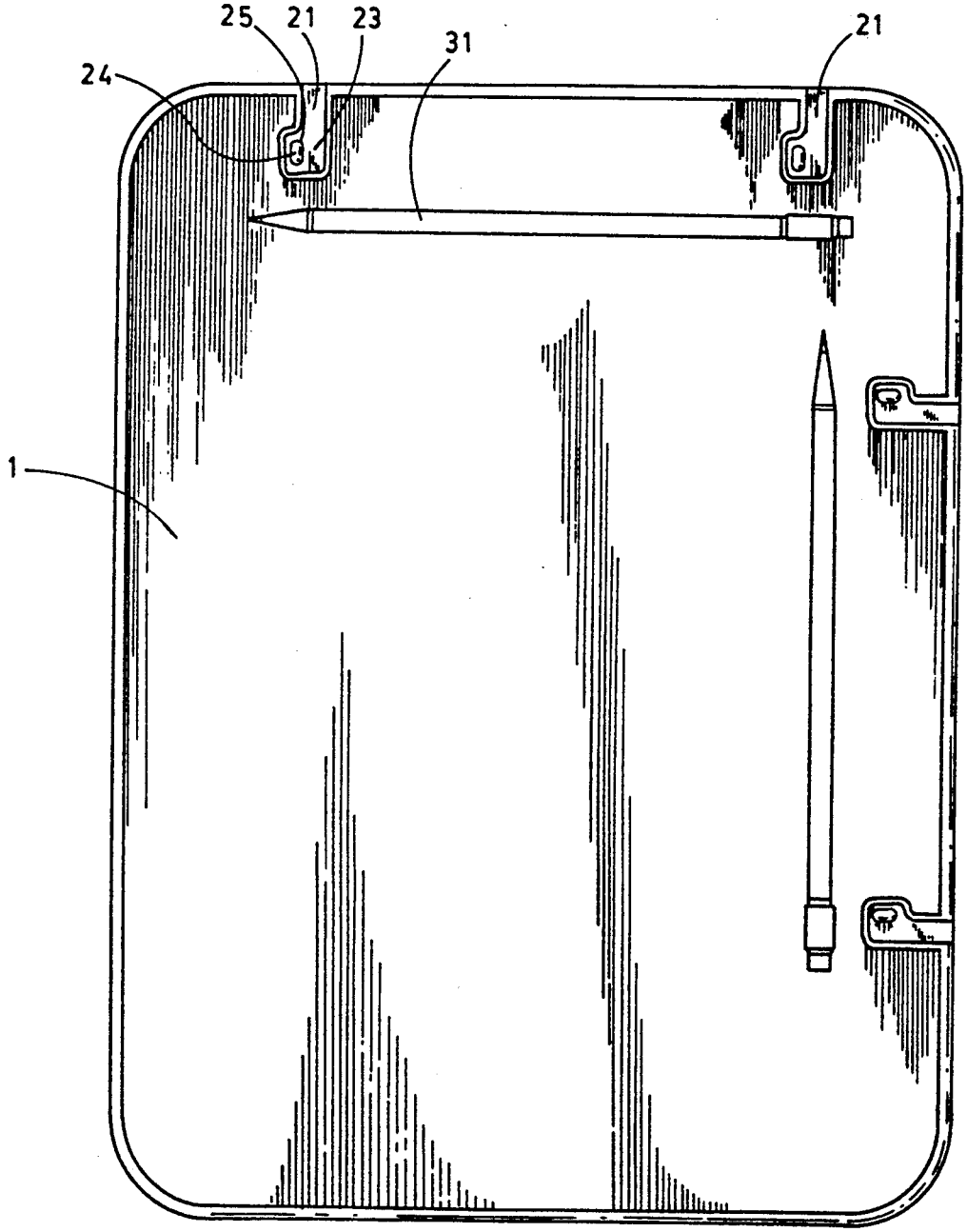
FIG. 8 is a bottom view of the board of the preferred embodiment.
Figure 9:
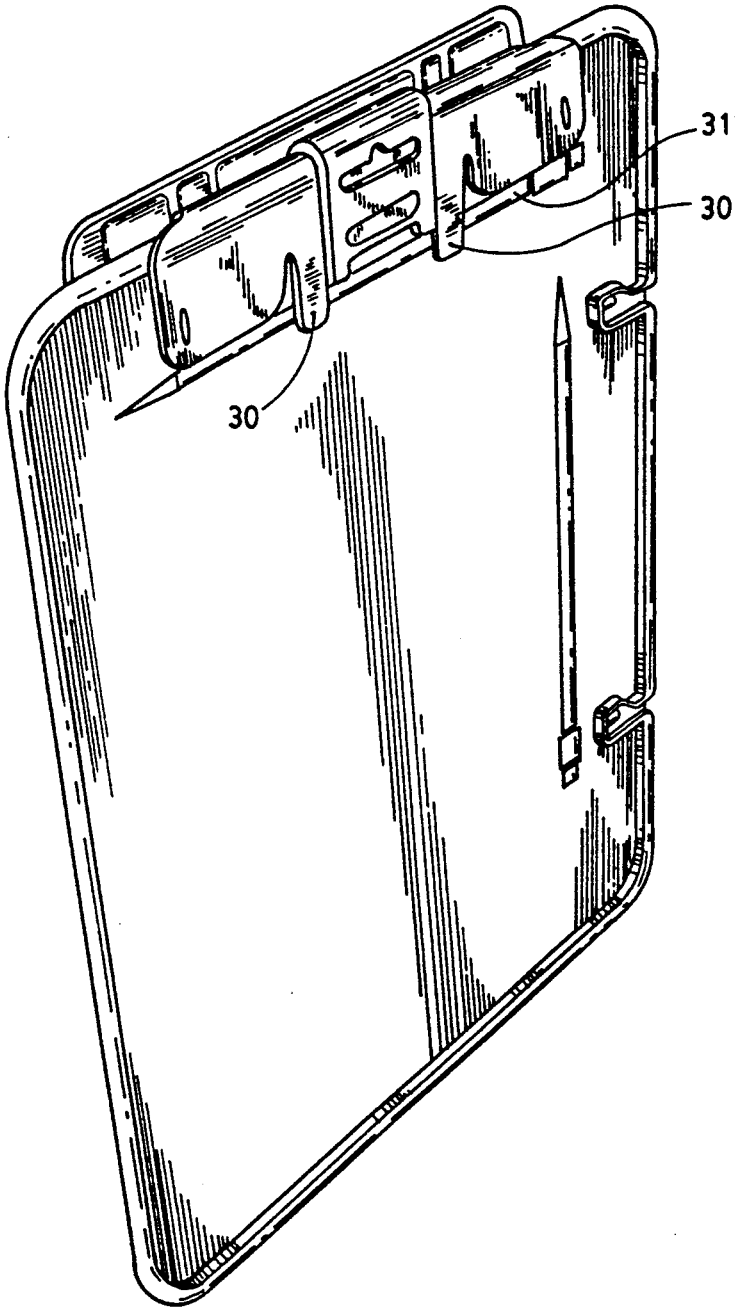
FIG. 9 is a perspective view illustrating the bottom of the clipboard of the preferred embodiment.

On the bottom portion 12 of the clamp 2 of the preferred embodiment a projection 20 is molded at each end. The projections 20 are elongated and mate with grooves 21 molded into the back of the board 1 (illustrated in FIG. 8). The projections 20 mate with the groove 21 in a male/female relationship.

In the preferred embodiment, the groove 21 has a long portion 23 and a side portion 24. When the clip 2 is mounted upon the board 1, the notch 20 interlocks with the groove 21 by sliding into the long portion 23 and over to the side portion 24.

This connection means provides an easy method and apparatus for locking the clip into position. However, any groove means having a tortuous path can be utilized in the preferred embodiment. In the preferred embodiment identical connection means are centrally located along the board's top edge and one side edge.

It should be noted that in the preferred embodiment, locking projections 25 are molded between the side portion 24 and the long portion 23 to lock the clip into place.

When the clip 2 is attached to the board 1, the projections 20 are slid into the grooves 21. The clip is held open during interlock. The projections 20 are caused to slide down the grooves 21's long portion 23 until it cannot travel any further. The clip 2 is then moved sideways so that projections 20 slide into side portion 24 of groove 21. Locking projections 25 will lend additional force to hold the clip 2 in place. Support projections can also be molded or displaced between the grooves 21 to prevent bowing of the clip when attached to the board.

FIGS. 3, 5, 6, 7, and 9 illustrate utensil locking projections 30 which are molded as part of the bottom piece 12 of the clip 2. These utensil projections 30 extend outwardly further than the edge of the bottom portion of the clip 12. When the clip 2 is locked in place on the board 1, the utensil projections 30 extend further to detachably accept a writing utensil (not shown).

In the board 1 utilized in the preferred embodiment, an indentation 31 is molded in the shape of a writing utensil. This indentation 31 serves several purposes including aiding the user in informing him or her where to place the writing utensil and adding additional interlock force so that the writing utensil will not be displaced.

In use, the projections 30 utilize the clip's own compressive force to lock the writing utensil in place. The writing utensil is placed in the indentation 31, and the projections 30 apply a compressive force clamping the writing utensil thereon. When the clip 2 is maintained in place by the positioning means of the preferred embodiment, a writing utensil may be slid below projections 30 in the space between projections 30 and the board 1. The writing utensil is then easily held in place for storage purposes.

Additionally, further attached to the bottom portion 12 of the clip 2 is hanging means 40. Hanging means 40 is a separately molded piece with a hook throughhole 41. As shown in the figures, hanging member 40 may be movably extended up and down to allow a hook such as nail (not shown) to extend through the hooking hole 41. In this way, the clipboard can be hung in a storage environment when not being used.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A clipboard, comprising:

(a) a board having a plurality of edges;

(b) a clip for holding workpieces to the board, the clip being detachably mountable to the board's edges; and (c) positioning means attached to the board, the positioning means for detachably mounting the clip at a particular position along each of the edges of the board, wherein the positioning means includes preformed grooves in the board's rear surface.

2. The apparatus of claim 1 wherein the clip has projections which interact with the preformed grooves to hold the clip in place.

3. The apparatus of claim 1 wherein the preformed grooves have a long portion and a side portion.

4. The apparatus of claim 3 wherein a locking projection is molded between the side portion and the long portion.

5. The apparatus of claim 1 wherein the grooves positioning means is a tortuous path.

6. The apparatus of claim 1 wherein positioning means are centrally located along a top edge and along a side edge of the board.

7. The apparatus of claim 1 further including writing utensil locking means for separately securing a writing utensil to the clipboard.

8. The apparatus of claim 1 further including hooking means for hanging the clip in place during storage.

9. A clipboard, comprising:

(a) a board having a plurality of edges;

(b) a clip for holding workpieces to the board, the clip being detachably mountable to the board's edges;

(c) positioning means attached to the board, the positioning means for detachably mounting the clip at a particular position along each of the edges of the board;

(d) a writing utensil locking means for separately securing a writing utensil to the clipboard, the writing utensil locking means including projections attached to the clip which interact with an indentation in the board to frictionally secure a writing utensil.

10. A clipboard, comprising:

a board having a top surface and a bottom surface, the board defining two longitudinal edges and two lateral edges;

a clip for holding workpieces to the board, the clip being detachably mountable at the board's edges, the clip having a top portion and a bottom portion, the top portion and the bottom portion being hingeably attached by a plurality of pivot mechanisms allowing resilient pivotable rotation of the top portion with respect to the bottom portion, the resilient rotation being biased to maintain the clip in a closed position, a top surface of the bottom portion having at least one securing projection extending upwardly; and positioning means attached to the board, the positioning means allowing the clip to be detachably mounted to the board at a particular position along each of the edges of the board, the positioning means including preformed grooves in the board's bottom surface for detachably accepting the projection on the top surface of the clip's bottom portion, the groove including a long portion, a side portion and a locking projection between the long portion and the side portion, the locking projection resiliently securing the clip in place when the securing projection is engaged within the side portion.

11. The clipboard of claim 10 wherein the pivot mechanisms include a pivot base attached to the bottom portion and a pivot attachment attached to the top portion, the pivot base and the pivot attachment being secured by a pin allowing pivoted rotation of the top portion with respect to the bottom portion, and a spring means for biasing the pivotable rotation to maintain the clip in a closed position.

* * * * *